US011752386B2

(12) United States Patent
Aberton et al.

(10) Patent No.: US 11,752,386 B2
(45) **Date of Patent: *Sep. 12, 2023**

(54) SPORTS SPECIFIC AND INJURY PREVENTING EXERCISE DEVICE

(71) Applicants: Mark Aberton, Holladay, UT (US); Kyle Aberton, Holldaday, UT (US)

(72) Inventors: Mark Aberton, Holladay, UT (US); Kyle Aberton, Holldaday, UT (US)

( * ) Notice: Subject to any disclaimer, the term of this patent is extended or adjusted under 35 U.S.C. 154(b) by 79 days.

This patent is subject to a terminal disclaimer.

(21) Appl. No.: 17/343,580

(22) Filed: Jun. 9, 2021

(65) Prior Publication Data

US 2021/0299509 A1 Sep. 30, 2021

Related U.S. Application Data

(63) Continuation of application No. 16/297,568, filed on Mar. 8, 2019, now Pat. No. 11,033,770.

(60) Provisional application No. 62/640,209, filed on Mar. 8, 2018.

(51) Int. Cl.

| | |
|---|---|
| ***A63B 21/072*** | (2006.01) |
| ***A63B 21/00*** | (2006.01) |
| ***A63B 21/078*** | (2006.01) |

(52) U.S. Cl.

CPC ..... *A63B 21/0728* (2013.01); *A63B 21/0724* (2013.01); *A63B 21/4035* (2015.10); *A63B 21/0783* (2015.10)

(58) Field of Classification Search

CPC ..... A63B 21/0728; A63B 21/0724; A63B 21/4035; A63B 21/0783; A63B 21/072; A63B 21/078; A63B 71/0054

See application file for complete search history.

(56) References Cited

U.S. PATENT DOCUMENTS

| | | | | |
|---|---|---|---|---|
| 7,736,284 | B1 * | 6/2010 | Andrews | A63B 21/072 482/92 |
| 8,128,541 | B2 * | 3/2012 | Hartman | A63B 21/4017 482/122 |
| 8,951,170 | B1 * | 2/2015 | Tayo | A63B 21/0728 482/139 |
| 8,986,172 | B2 * | 3/2015 | Poole | A63B 23/03541 473/441 |
| 8,998,778 | B2 * | 4/2015 | Potts | A63B 21/0724 482/106 |

(Continued)

*Primary Examiner* — Joshua Lee

*Assistant Examiner* — Kathleen M Fisk

(74) *Attorney, Agent, or Firm* — Superior IP, PLLC; Dustin L. Call

(57) ABSTRACT

A sports specific and injury preventing exercise device for exercising a user. The sports specific and injury preventing exercise device includes a frame and a pair of handles on the frame. The pair of handles are parallel to one another, configured to be parallel to a trunk of the user, offset relative to the frame, and on opposite sides of the frame. The sports specific and injury preventing exercise device also includes a flat support area in a middle of the frame, wherein the flat support area is configured to support one or more weight plates, and a sleeve attached to the flat support area. The sleeve is perpendicular to each of the pair of handles, perpendicular to the flat support area and located at a center point of the frame. The sports specific and injury preventing exercise device additionally includes one or more assist handles.

18 Claims, 9 Drawing Sheets

(56) References Cited

U.S. PATENT DOCUMENTS

| | | | | |
|---|---|---|---|---|
| 9,937,373 | B2 * | 4/2018 | Gvoich | A63B 21/4035 |
| 11,033,770 | B2 * | 6/2021 | Aberton | A63B 71/0054 |

* cited by examiner

SPORTS SPECIFIC AND INJURY PREVENTING EXERCISE DEVICE

CROSS-REFERENCE TO RELATED APPLICATIONS

This application claims the benefit of and priority to U.S. Non-Provisional patent application Ser. No. 16/297,568 filed on Mar. 8, 2019, which application is incorporated herein by reference in its entirety.

Patent application Ser. No. 16/297,568 claims the benefit of and priority to U.S. Provisional Patent Application Ser. No. 62/640,209 filed on Mar. 8, 2018, which application is incorporated herein by reference in its entirety.

BACKGROUND OF THE INVENTION

Traditionally, workouts with large amounts of weights are done using barbells and dumbbells. Barbells and dumbbells can support enormous amounts of weight, they are ubiquitous, and they can be used in a variety of exercises. In addition, barbells and dumbbells are usually standardized to weight and length. This means that barbells and dumbbells are found in virtually every gym and a user can easily move from one workout location to another and immediately be able to resume an exercise routine.

However, barbells and dumbbells suffer from a number of drawbacks. For example, the weight is not placed near the center of mass of the user. This leads to torque on the user's body (including the user's spine and extremities) which can, in turn, lead to injury. In addition, because the weight is not secured by gravity any imbalance can quickly lead to shifts in the weight which causes greater torque and can cause immediate and long-term including accumulative and repetitive trauma injury. This is particularly true in the shoulders, elbows, wrists and spines of the user.

Finally, a barbell may have a significant amount of weight by itself. For example, many barbells weight forty-five pounds without any weight being added. Therefore, if a user is not able to lift with a minimum of forty-five pounds, injury is likely to occur, and the user is unlikely to develop proper technique. In addition, a standard barbell distributes the weight distally (i.e., toward the ends of the bar) which exponentially magnifies any issues with tipping or uneven lifting of the bar. This creates a high amount of torque which magnifies injury risk. This means that new weight lifters are more likely to experience injury than more experienced users.

Accordingly, there is a need in the art for a weightlifting device that allows a user to center the weight relative to the user's body. Further, there is a need in the art for the weight lifting device to prevent torque on the user's body.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a sports specific and injury preventing exercise device for exercising a user. The sports specific and injury preventing exercise device includes a frame and a pair of handles on the frame. The pair of handles are parallel to one another, parallel to the trunk of a user, offset relative to the frame, and on opposite sides of the frame. The sports specific and injury preventing exercise device also includes a flat support area in the middle of the frame, where the flat support area is configured to support one or more weight plates. The sports specific and injury preventing exercise device further includes a sleeve attached to the flat support area and one or more assist handles, where the assist handles are configured to allow a spotter to support the weight of the frame.

One example embodiment includes a sports specific and injury preventing exercise device for exercising a user. The sports specific and injury preventing exercise device includes a frame and a pair of handles on the frame. The pair of handles are parallel to one another, configured to be parallel to a trunk of the user, offset relative to the frame, and on opposite sides of the frame. The sports specific and injury preventing exercise device also includes a flat support area in a middle of the frame, wherein the flat support area is configured to support one or more weight plates. The sports specific and injury preventing exercise device further includes a sleeve attached to the flat support area. The sleeve is perpendicular to each of the pair of handles, perpendicular to the flat support area and located at a center point of the frame. The sports specific and injury preventing exercise device additionally includes one or more assist handles. The assist handles are configured to allow a spotter to support a weight of the frame and are each perpendicular to the sleeve.

Another example embodiment includes a sports specific and injury preventing exercise device for exercising a user. The sports specific and injury preventing exercise device includes a frame, wherein the frame is approximately rectangular and a pair of handles on the frame. The pair of handles are parallel to one another, configured to be parallel to a trunk of the user, offset relative to the frame, and on opposite sides of the frame. The sports specific and injury preventing exercise device also includes a flat support area in a middle of the frame, wherein the flat support area is configured to support one or more weight plates and a sleeve attached to the flat support area. The sleeve is perpendicular to each of the pair of handles, perpendicular to the flat support area and located at a center point of the frame. The sports specific and injury preventing exercise device further includes a pair of assist handles. The pair of assist handles are configured to allow a spotter to support a weight of the frame and are each perpendicular to the sleeve.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1A:
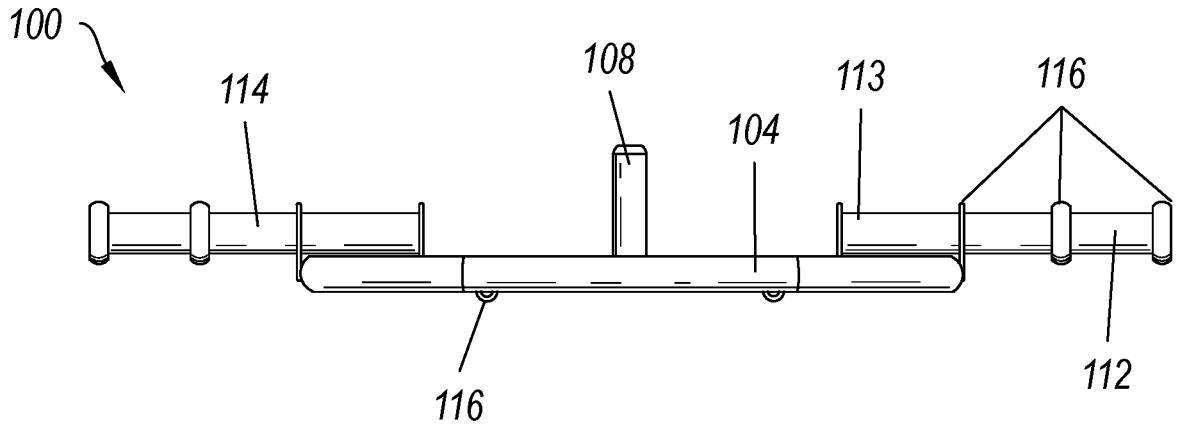
FIG. 1A illustrates a rear view of a sports specific and injury preventing exercise device.
Figure 1B:
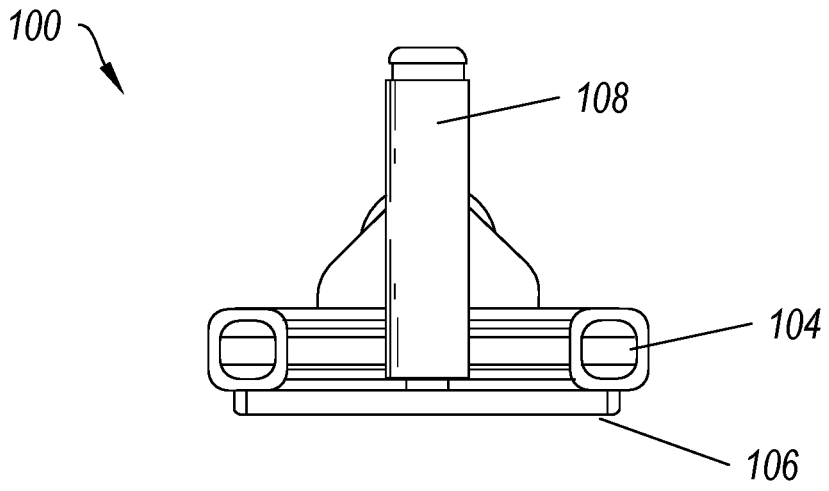
FIG. 1B illustrates a cross-sectional view through the line A-A of FIG. 1A.
Figure 1C:
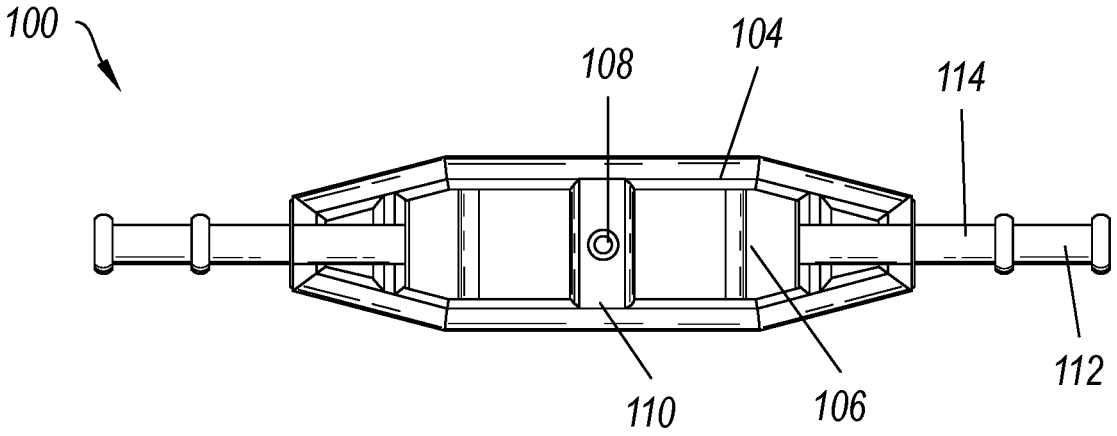
FIG. 1C illustrates a top view of the sports specific and injury preventing exercise device.
Figure 1D:
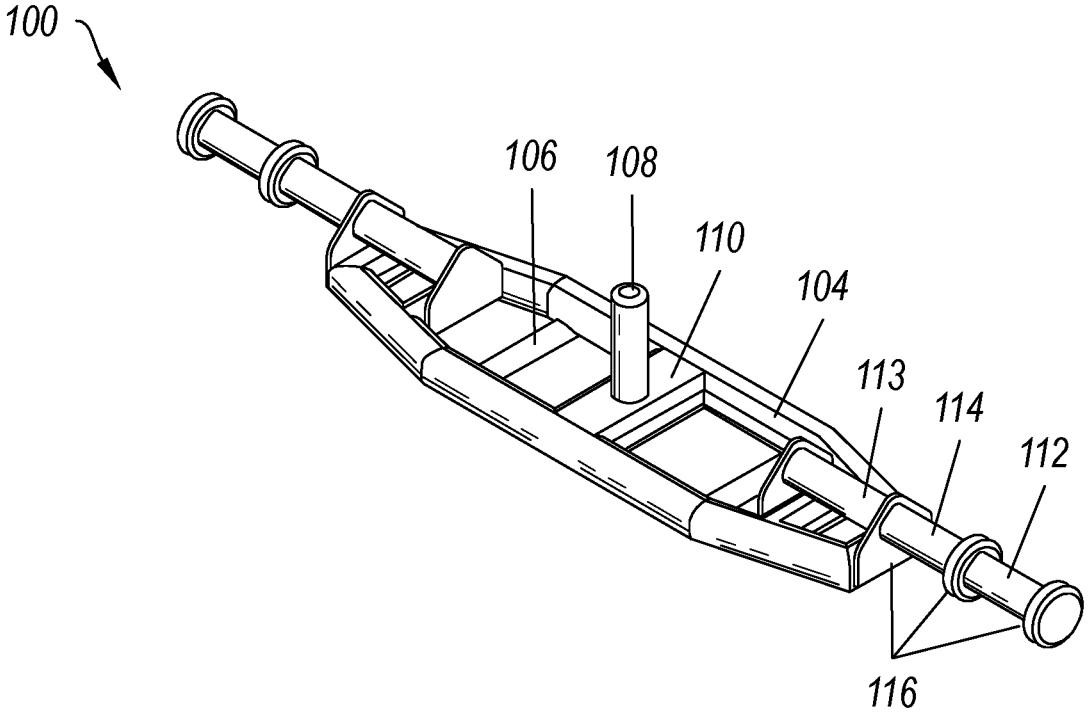
FIG. 1D illustrates a rear top right isometric view of the sports specific and injury preventing exercise device.
Figure 1E:
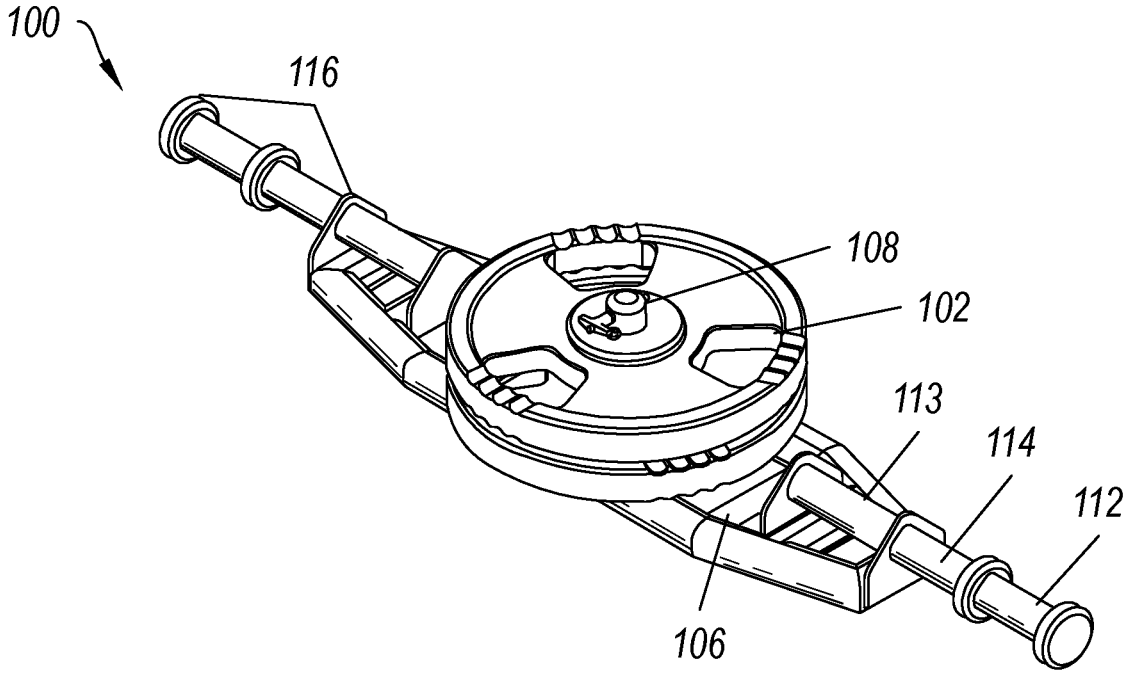
FIG. 1E illustrates a rear bottom top isometric view of the sports specific and injury preventing exercise device in combination with weight plates.
Figure 1F:
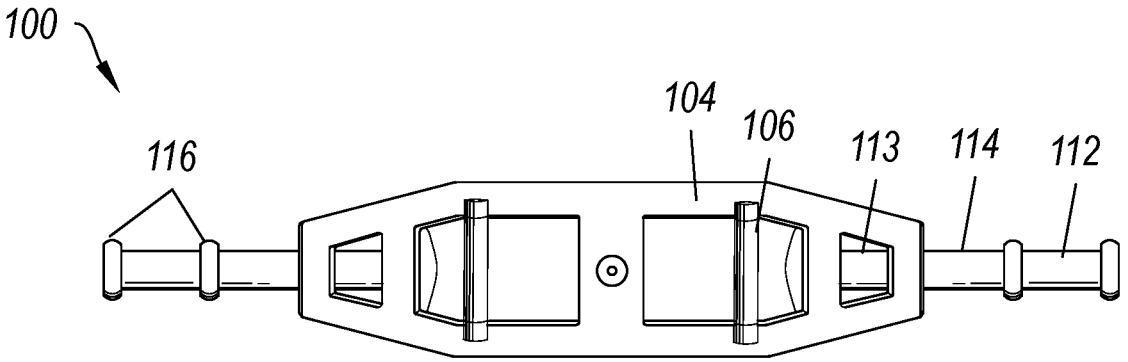
FIG. 1F illustrates a bottom view of the sports specific and injury preventing exercise device.
Figure 1G:
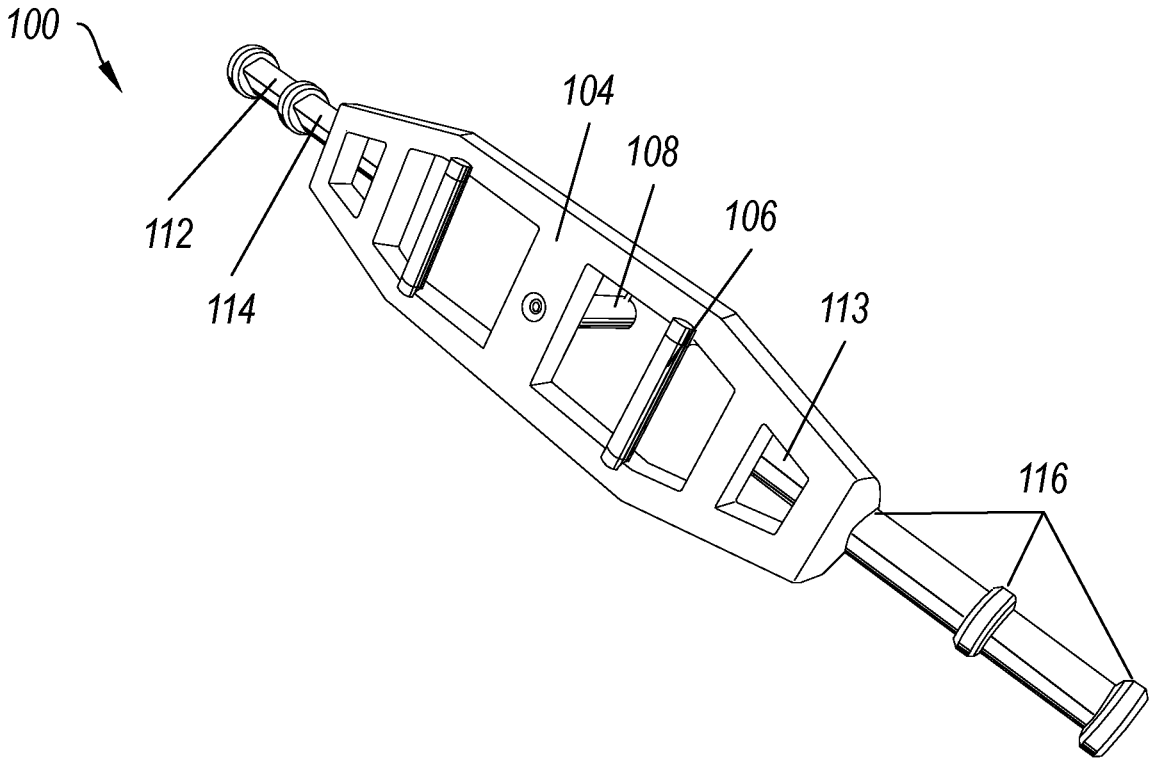
FIG. 1G illustrates a front bottom left isometric view of the sports specific and injury preventing exercise device.

FIGS. 1A-1E (collectively "FIG. 1") illustrate an example of a sports specific and injury preventing exercise device 100. FIG. 1A illustrates a rear view of a sports specific and injury preventing exercise device 100, FIG. 1B illustrates a cross-sectional view through the line A-A of FIG. 1A, FIG. 1C illustrates a top view of the sports specific and injury preventing exercise device 100, FIG. 1D illustrates a rear bottom right isometric view of the sports specific and injury preventing exercise device 100, FIG. 1E illustrates a rear bottom right isometric view of the sports specific and injury preventing exercise device 100 in combination with weight plates 102; FIG. 1F illustrates a bottom view of the sports specific and injury preventing exercise device 100; and FIG. 1G illustrates a front bottom left isometric view of the sports specific and injury preventing exercise device 100. The sports specific and injury preventing exercise device 100 is used for sports conditioning in athletes. In particular, the sports specific and injury preventing exercise device 100 allows an athlete to perform an exercise, such as a bench press, in a way that better builds muscle in a manner that directly correlates to better performance in sports because it correlates to the motor pattern used by athletes in sport rather than attempting to build raw power.

FIG. 1 shows that the sports specific and injury preventing exercise device 100 is designed to be held by a user in a manner that differs from a traditional barbell. For example, a barbell is held with hands perpendicular to the trunk of the user (i.e., left to right as viewed by the user) whereas the sports specific and injury preventing exercise device 100 turns the hands of the user so that they are parallel to the trunk of the user and dumbbells may be held parallel to the user's trunk, but the width is not fixed and can vary. Thus, the grip pattern of the sports specific and injury preventing exercise device 100 more closely matches the hands of the user when playing sports, where the upper arm remains close to the chest and the lower arms extend forward from the trunk. Hands parallel to the trunk is the most accurate reproduction of the motor pattern to improve an athlete's speed, acceleration, explosiveness velocity, athleticism, etc. For example, football players who are blocking attempt to keep their hands as close to the center of their chest as possible, which allows them to use the most power in blocking as well as avoiding fouls, such as holding. I.e., rather than focus on building raw power, the grip pattern of the sports specific and injury preventing exercise device 100 allows an athlete to build power that is directly applicable to his/her sport.

FIG. 1 shows that the sports specific and injury preventing exercise device 100 can include a frame 104. The frame 104 is the base structure of the sports specific and injury preventing exercise device 100. I.e., the frame 104 supports the weight plates 102 that the user will be lifting in the desired configuration. The frame 104 needs to be of sufficient strength to support a large amount of weight, since some athletes (e.g., football linemen) will be striving to lift heavy weights as part of the exercise routine. Therefore, the frame 104 should be composed of material that is able to support large amounts of weight, such as steel. The width (measured side to side in FIG. 1A) and depth (measured up and down in FIG. 1A of the frame 104 can be critical to ensure that the frame 104 can support the weight plates 102. For example, the width of the frame 104 can be between 29 and 49 inches and the depth of the frame 104 can be between 7.5 and 12.5 inches. In particular, the width of the frame 104 can be approximately 39 inches and the depth of the frame 104 can be approximately 10 inches. The frame is rectangular or approximately rectangular (i.e., parallel sides but with corners that may be rounded or cutoff). A rectangular frame can be critical to ensure that the user's hands are placed in the correct position, as described below.

FIG. 1 also shows that the sports specific and injury preventing exercise device 100 can include handles 106. The handles 106 transfer all of the weight of the sports specific and injury preventing exercise device 100 and the weight plates 102 to the hands of the user. Thus, the handles 106 must be secured to the frame 104 in a safe manner. Typically, the handles 106 will be welded to the frame 104 or made of the same piece of material as the frame 104. In addition, the handles 106 are offset relative to the frame 104 in the sports specific and injury preventing exercise device 100. This prevents injury to the user's hands due to weight placement. I.e., it provides space between the user's hands and the plates so that the plates don't contact the user's hands during exercise. In FIG. 1A the handles 106 are the lowest points of the sports specific and injury preventing exercise device, showing the vertical offset from the frame 104. The offset of the handles can be between 0.25 and 0.75 inches. In particular, the offset of the handles can be approximately 0.5 inches. Further, the handles 106 are designed to keep the hands of the user near the center of the user's trunk. For example, the spacing of the handles 106 can be between 12 inches and 22 inches. Specifically, the spacing of the handles 106 can be approximately 17 inches.

FIG. 1 further shows that the sports specific and injury preventing exercise device 100 can include a sleeve 108. A barbell has sleeves for weighted plates on the ends of a shaft. This means that the weight is on the ends of a lever, inducing a torque on the shoulders, spine, and extremities of the user. There are numerous instances of injury to shoulders, spines and other areas of an athlete from the application of this torque. In addition, when a user is attempting to lift as much weight as possible, minor differences in strength between the user's right side and left side can now become a factor, resulting in one end of the bar being higher than the other end. This can cause weight to shift or fall off the sleeves creating a whiplash effect. In addition, this effect is exponential, so the user can be fine at one weight, then when even a little additional weight is added, then the torque becomes too much and significant injury occurs.

For example, if the user is slightly stronger on his/her right side then the height of the sleeve on the right side of the barbell may be greater than the height of the sleeve on the left side. This can cause the plates on the left slide to slide out from the center of the bar. Since the barbell essentially acts as a lever, this increase in distance creates a need for greater force to elevate the same mass but, with the athlete near or at capacity for lifting weight, in reality the left sleeve sinks lower, causing a greater imbalance. If the user or nearby spotter is unable to correct this imbalance, then the weight will shift further left until it drops off the sleeve at which time the left side of the bar will accelerate forward (because of the force being applied by the user) making the left sleeve much higher than the right sleeve, which begins dipping toward the floor, causing the weight on the right side to drop off. This is a dangerous situation for the user and anyone else near the user at the time (as weighted plates, barbells, dumbbells, etc. are now in motion) and because of the extreme amount of torque that was applied first one direction, then suddenly is applied in the direct opposite direction.

Some athletes use locking collars to prevent weight shifting. While the locking collars work in preventing weight shift, in the case above they often lead to a situation where the left sleeve falls to the point that it hits the floor or other obstacle and the user may be stuck in a position where he/she is trapped by the barbell that he/she is unable to lift. Therefore, on the sports specific and injury preventing exercise device 100, the sleeve 108 for the plates is aligned in a vertical direction (up as shown in FIG. 1A). Thus, the plates are held in the center of the sports specific and injury preventing exercise device 100, directly above the chest of the user during a bench press exercise (i.e., perpendicular to the plane created by the frame 104). This removes virtually all of the torque on the shoulders of the user, preventing a major source of injury to weight lifters. A locking pin can be used to retain the position of the weighted plates if desired but is not needed for movements that are vertical movements (as shown in FIG. 1A). I.e., if the user is standing vertically and pushing the plate horizontally, then a locking pin or locking collar can be used to prevent the weight plates 102 from being pushed off the sleeve 108. The length and diameter of the sleeve 108 can be critical to ensure that the sleeve 108 can accept the weight plates 102. I.e., the sleeve 108 does not accept the same amount of weight plates 102 as a traditional barbell because there may be a single sleeve 108 rather than multiple sleeves. So, if the user is using four weight plates 102, then each sleeve on a barbell needs to accommodate a single weight plate 102; however, on the sports specific and injury preventing exercise device 100 the sleeve 108 may need to accommodate all four weight plates 102. Thus, the length of the sleeve can be between 6 and 10 inches. In particular, the length of the sleeve 108 can be approximately 8 inches. The diameter of the sleeve is configured to match the standard diameter of weight plates 102, which is approximately 1 inch.

The location of the sleeve 108 positions the resistance mass and weight plates 102 directly over the midline of the user's chest. This positioning along with the handles 106 being parallel to the trunk of the user provides a strategic advantage both in wellness, health, strength training as well as sports specific power, speed, explosiveness and vertical jump training. This provides benefits in at least two areas: 1) sports specific performance training; and 2) minimizing and decreasing injury risk to the users. In particular, these benefits are accomplished in the following ways:

1. Sports specific performance training in the normal and natural physiological plane of the scapula reinforces and matches the natural motor pattern of the user; and;
2. Minimizing the risk of injury occurs as a result of the hand position along with the position of the sleeve 108 of the resistance decreasing the stress strain and repetitive trauma to the shoulder complex, elbow and wrist.

In particular, straight barbells keep the weight away from the user's midline and put the arms in abduction (i.e., with the elbows bent and moving away from the trunk of the user). This causes numerous injury issues including:

1. Sports specific performance training in the normal and natural physiological plane of the scapula reinforces and matches the natural motor pattern of the user; and;
2. Abduction of the arm is identified as the "closed pack" position for the glenohumeral joint. In physical therapy, the "open pack" (or "loose pack") position of a joint is the position with the least amount joint surface congruency, capsule and support ligaments are lax, and accessory motion or joint play is maximized. In contrast the "closed pack" position of a joint is the position with the most amount of joint congruency, capsule and supporting ligaments maximally tight, and accessory motion is minimized. This means that movement and joint loading should be minimized in the closed pack position and maximized in the open pack position to reduce stress on joint (in the case of abduction, the shoulder) structures and tissues.
3. Abduction of the shoulder increases tension on the long head of the bicep tendon and the pectorals tendon potentially causing injury and rupture to those structures.
4. Abduction maximizes tension on both the middle and inferior bands of the glenohumeral ligament (the z ligament). Repetitions with weight in abduction can cause ligament laxity, subluxations, and dislocations.
5. Abduction causes the greater tuberosity of the humerus to approximate and impinge the glenoid and glenoid labrum.
6. Abduction and external rotation when re-racking the traditional bar stresses and compromises the rotator cuff muscles.
7. Abduction limits horizontal extension to 30 degrees. Lowering the bar to your chest stresses the posterior structures of the shoulder.
8. Elbow collateral ligaments are tightened and stretched with heavy loads at full extension.
9. Wrist flexion and extension with traditional bars under load cause stress strain in the joint.

All these issues are magnified exponentially when the distal weights on the traditional bars are tipped or unbalanced in any fashion. In contrast, the speed bar 100 neutralizes and minimizes these risks in the following ways;

1. The center position of the sleeve 108 keeps the resistance mass and weight plates 102 directly over the midline of the user's chest. Therefore, any tipping or balance issues do not cause stress or strain on the shoulder structures. I.e., the exponential whiplash effect is gone.

2. With the hands parallel to the trunk the humerus is not abducted but is positioned in the physiological plane of the scapula. This positions the glenohumeral joint in the loose pack position for the shoulder where there is little or no stress or strain on the joint.
3. In the physiological plane there is the least amount of tension on the long head of the bicep and the pectoralis muscle.
4. In the physiological plane there is less tension on the glenohumeral ligament. I.e., no ligament laxity is being created.
5. In the physiological plane the greater tuberosity does not approximate on the glenoid or glenoid labrum.
6. In the physiological plane the rotator cuff muscles are in equilibrium. I.e., no stress or strain is created on the user's rotator cuff when re-racking the new bar.
7. In the physiological plane neutral extension is 50 degrees decreasing stress/strain on the posterior shoulder capsule of the user.
8. There is less stress on the elbow collateral ligaments preventing laxity in the elbow joint of the user.
9. There is less stress on the wrist because the new bar does not roll in the user's grip.

Therefore, the spacing, placement and orientation of both the handles 106 and the sleeve 108 are critical for minimizing injury risk to the user and maximizing the user's sport specific strength and training.

FIG. 1 moreover shows that the sports specific and injury preventing exercise device 100 can include a flat support area 110 configured to receive the weight plates 102. This flat area 110 ensures that the weight plates 102 are balanced and fully supported when they are placed on the sleeve. Sitting the weight plates 102 flat on the support area 110 reduces torque caused by imbalance in height between the left side and the right side of the sports specific and injury preventing exercise device 100. I.e., since torque is caused by increased distance of the center of mass of each weight plate 102 from the center of the sports specific and injury preventing exercise device 100, and since any height imbalance only shifts the centers of mass of the weight plates 102 a very small distance very little torque is created.

FIG. 1 further shows that the sports specific and injury preventing exercise device 100 includes assist handles 112. These assist handles 112 are placed to the side of the sports specific and injury preventing exercise device 100. When performing a traditional bench press with a barbell a spotter stands near the head of the user and if the user is unable to complete a repetition, then the spotter pulls up on the bar, providing sufficient aid for the user to complete the exercise. However, in the case of weight lifting with heavy weights, the spotter is unable to support all of the weight in this position. This means that if something happens to the user (such as a muscle tear, fainting, etc.) the weight lands of the chest of the user or any support structures. Assist handles 112 on the side of the sports specific and injury preventing exercise device 100 allow either one person to spot in a traditional manner or two people to spot if necessary, supporting greater weight and to do so in a position that is more natural for lifting heavy weights. I.e., the assist handles 112 allow a single spotter to "shrug" the sports specific and injury preventing exercise device 100 and allows two spotters to either "shrug" or "deadlift" the sports specific and injury preventing exercise device, which allows the spotter(s) to support more weight if necessary. The length (as measured side to side in FIG. 1A) and placement of assist handles 112 can be critical to ensure that a spotter can help a user when needed. The placement of the assist handles 112 is dictated, at least in part, by the size of the frame 104 and can be critical to allow the speed bar 100 to be racked, as described below. The spacing between the assist handles 112 (the closest distance between the assist handles 112) can be between 37.5 and 62.5 inches and the length of the assist handles 112 can be between 4 and 6 inches. In particular, spacing between the assist handles 112 can be approximately 50 inches and the length of the assist handles 112 can be approximately 5 inches.

FIG. 1 also shows that the sports specific and injury preventing exercise device 100 can include inner assist handles 113. The inner assist handles 113 allow a single spotter to assist the user. I.e., the inner assist handles 113 ensure that if only a single spotter is present, then the spotter can shrug the weight of the sports specific and injury preventing exercise device 100 and the added weight plates 102 to help the user rack the weight. The placement of the inner assist handles 113 is dictated, at least in part, by the size of the frame 104 and can be critical to allow the speed bar 100 to be racked, as described below. The spacing between the inner assist handles 113 can be between 18 and 32 inches and the length of the inner assist handles 113 can be between 5 and 9 inches. In particular, spacing between the inner assist handles 113 can be approximately 25 inches and the length of the inner assist handles 113 can be approximately 7 inches.

Additionally, FIG. 1 shows that the sports specific and injury preventing exercise device 100 can include one or more supports 114 that extend from each side. These supports 114 are shaped such that they fit into the trough of a bar catch. I.e., a bar catch has a 90-degree bend that is offset from vertical by 45 degrees. Thus, the support 114 is likewise rectangular (or approximately rectangular) and offset from vertical by 45 degrees which can allow the sports specific and injury preventing exercise device 100 to be used on weight lifting racks. I.e., the support 114 can prevent any rolling of the sports specific and injury preventing exercise device 100 allowing a user to place the sports specific and injury preventing exercise device 100 on a rack when weight is being added. I.e., the shape and length of the supports 114 can be critical to ensure that the sports specific and injury preventing exercise device 100 does not injure the user. A round barbell will sit on the bar catch and there is essentially no torque because the round (or approximately round) weight plates sit on sleeves that are on the ends of the barbell. Thus, there is no or very little torque attempting to rotate the barbell. In contrast, the sports specific and injury preventing exercise device 100 has weight plates 102 that are aligned vertically relative to the sports specific and injury preventing exercise device 100. This means that any rotation relative to the bar catch creates an imbalance (around an axis that goes left to right in FIGS. 1A and 1C). That imbalance creates a torque that wants to increase the imbalance. This feedback cycle can cause the sports specific and injury preventing exercise device 100 to tip. Therefore, a support 114 that is rectangular and offset 45 degrees can be critical to preventing that imbalance. Therefore, the length of the supports 114 can be between 4 and 8 inches and the sides of the supports 114 (i.e., the length of the sides as seen in cross-section) can be between 0.5 and 1.5 inches. In particular, the length of the supports 114 can be approximately 6 inches and the sides of the supports 114 can be approximately 1 inch. One of skill in the art will appreciate that without supports 114 the frame can be of sufficient width to ensure that the sports specific and injury preventing exercise device 100 will rest on racks for the same purpose.

FIG. 1 moreover shows that the sports specific and injury preventing exercise device 100 can include stops 116 between the supports 114 and the assist handles 112 and between the supports 114 and the inner assist handles 112 and on the ends of the assist handles. The stops 116 ensure that when the sports specific and injury preventing exercise device 100 is racked, that the bar must be moved vertically to be removed from the rack. I.e., the stops 116 ensure that the speed bar 100 cannot be moved horizontally until the end of the assist handles 112 slides off the bar catch.

Figure 2A:
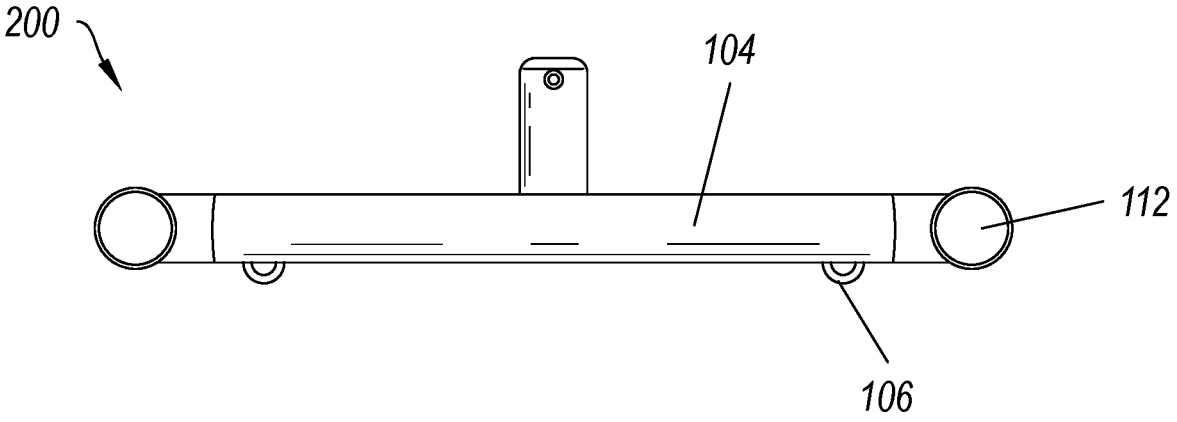
FIG. 2A illustrates a rear view of a kid plate.
Figure 2B:
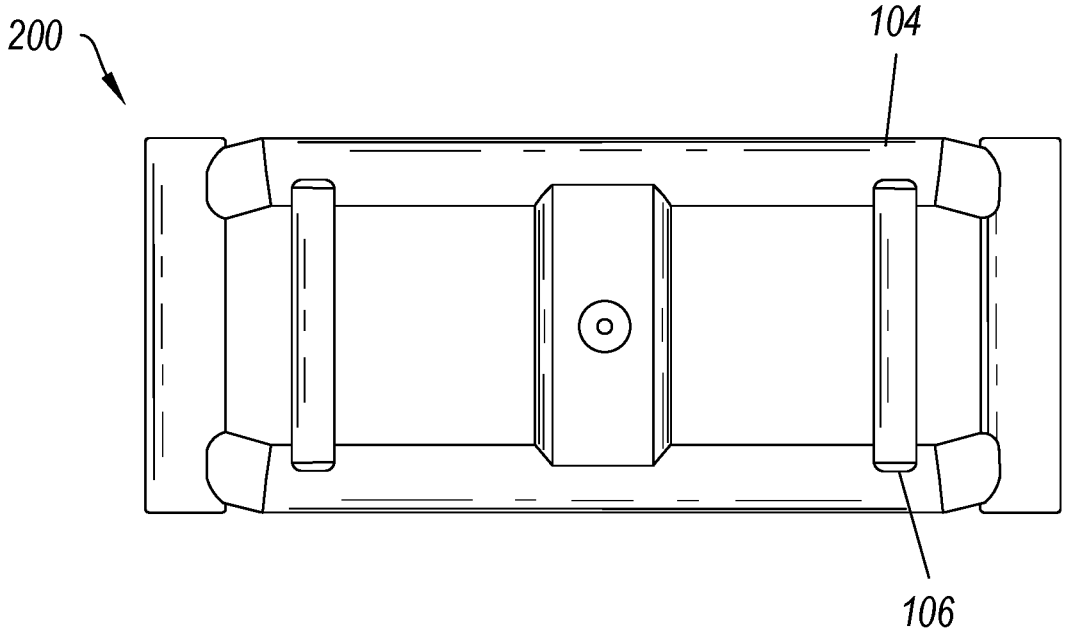
FIG. 2B illustrates a bottom view of the kid plate.
Figure 2C:
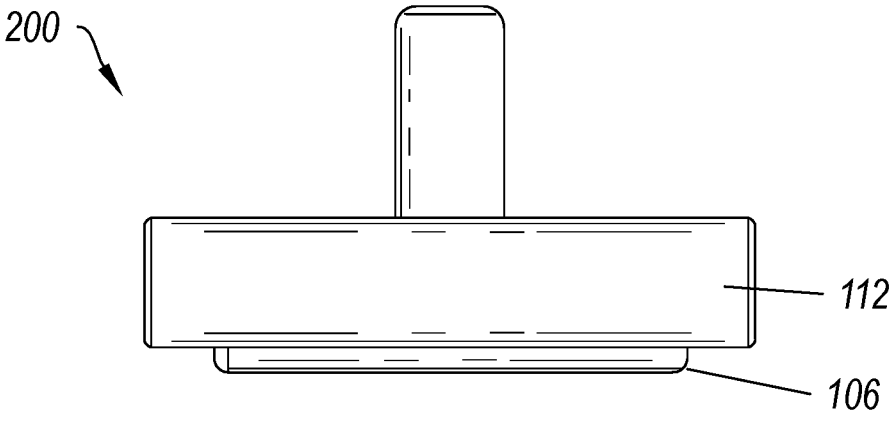
FIG. 2C illustrates a left view of the kid plate.
Figure 2D:
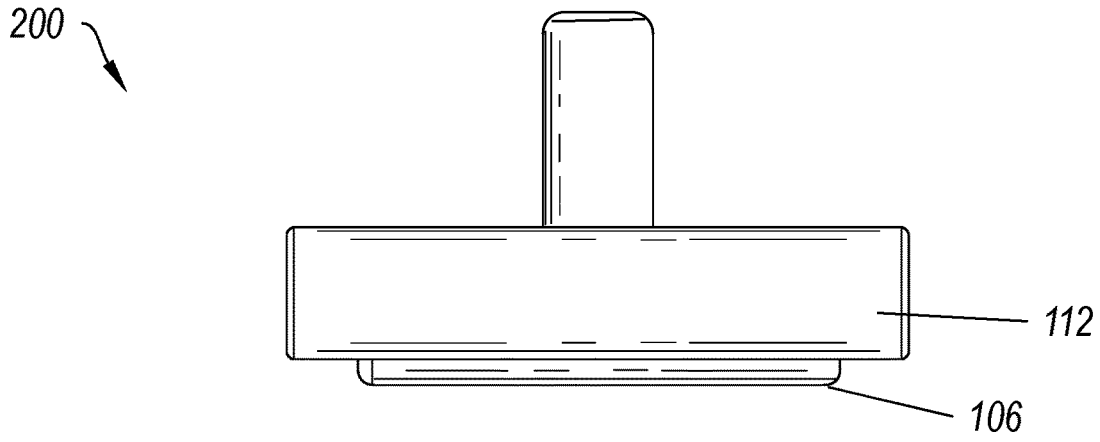
FIG. 2D illustrates a right view of the kid plate.
Figure 2E:
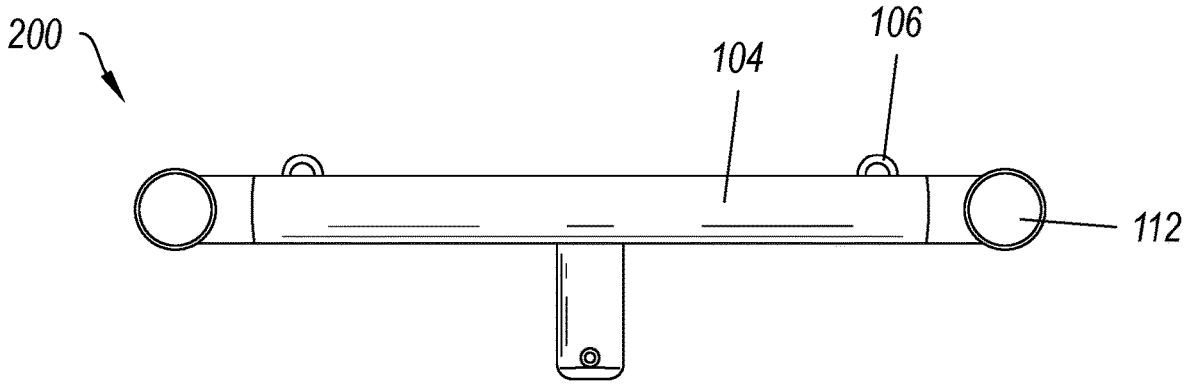
FIG. 2E illustrates a front view of the kid plate.
Figure 2F:
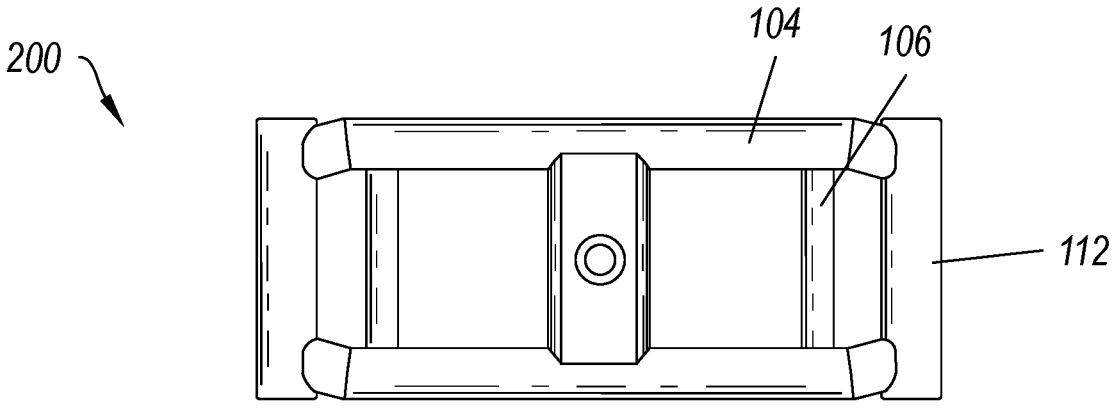
FIG. 2F illustrates a top view of the kid plate.
Figure 2G:
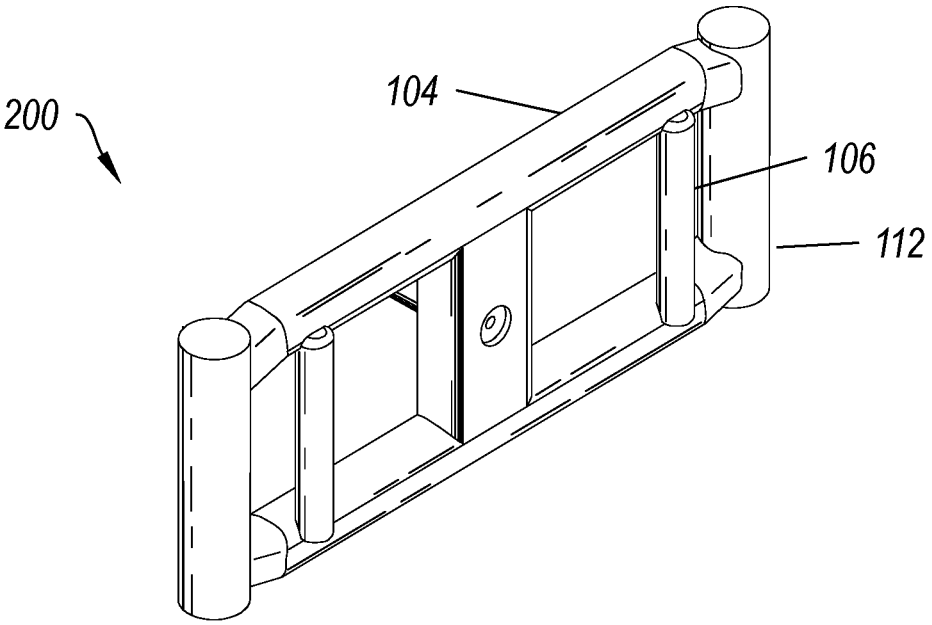
FIG. 2G illustrates a bottom front left isometric view of the kid plate.
Figure 2H:
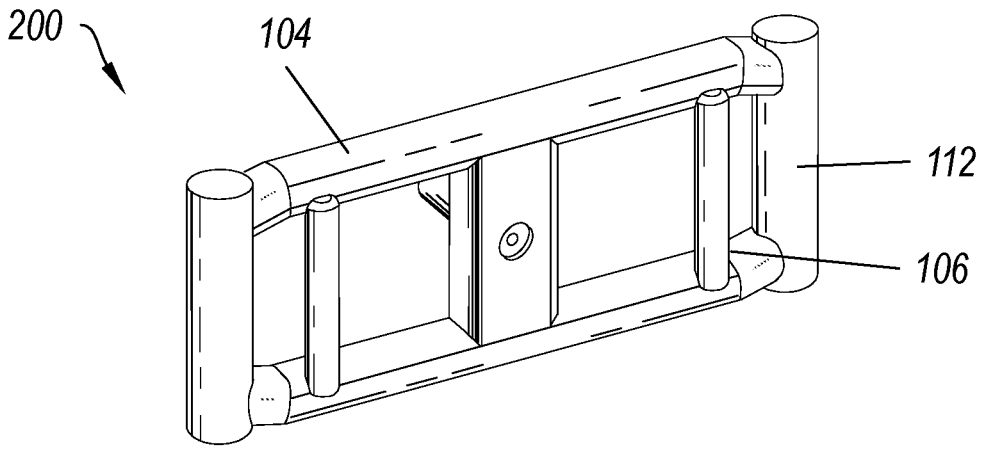
FIG. 2H illustrates an alternative bottom front left isometric view of the kid plate.
Figure 2I:
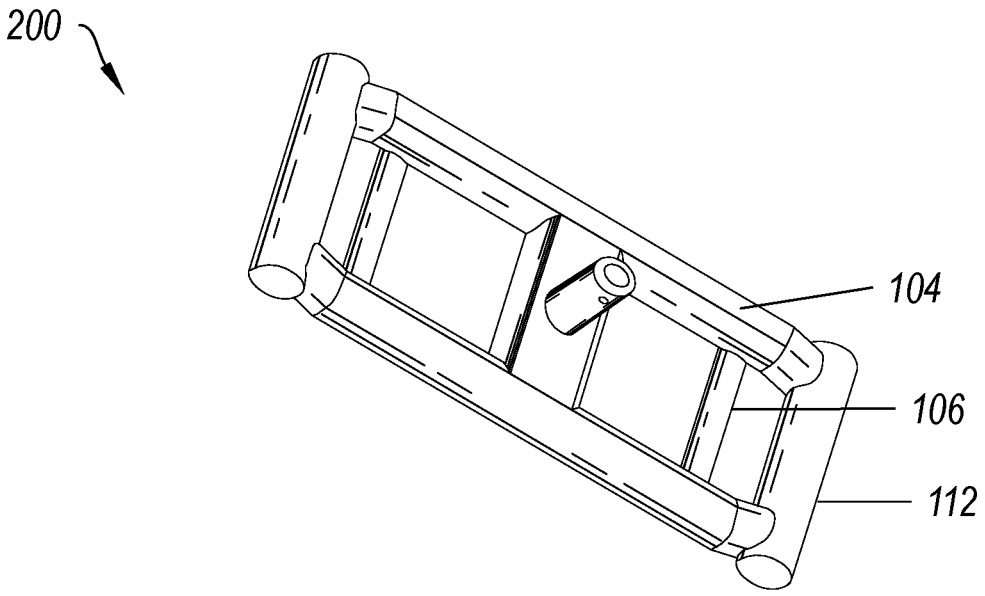
FIG. 2I illustrates a top rear right isometric view of the kid plate.
Figure 2J:
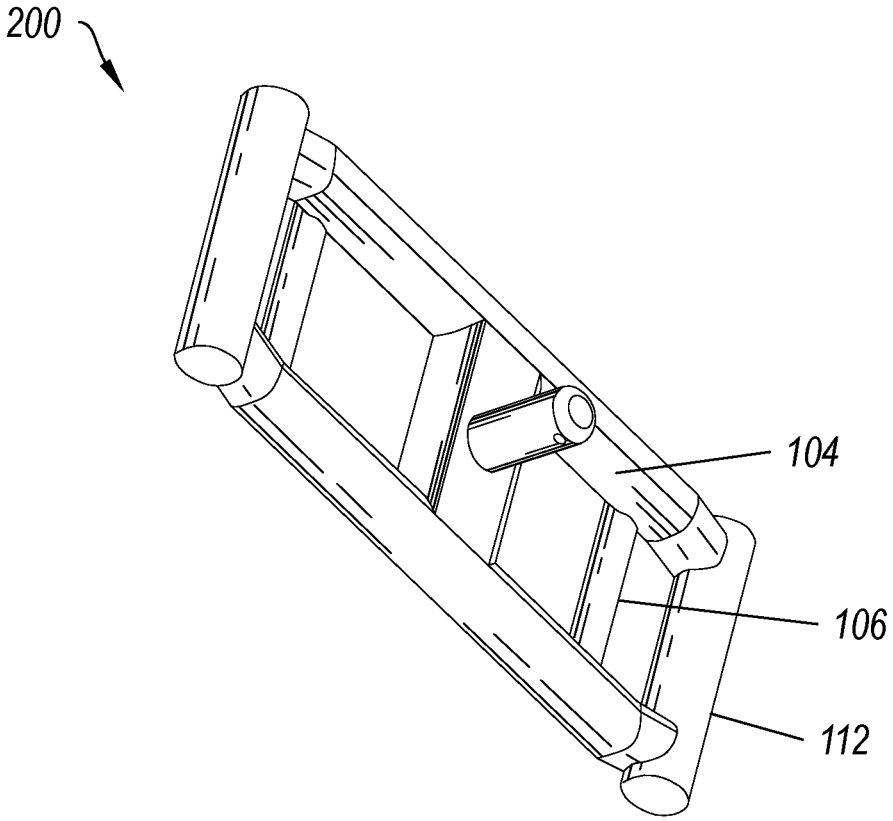
FIG. 2J illustrates an alternative top rear right isometric view of the kid plate.

FIGS. 2A-2J (collectively "FIG. 2") illustrate an example of a kid plate 200. FIG. 2A illustrates a rear view of a kid plate 200, FIG. 2B illustrates a bottom view of the kid plate 200, FIG. 2C illustrates a left view of the kid plate 200, FIG. 2D illustrates a right view of the kid plate 200, FIG. 2E illustrates a front view of the kid plate 200, FIG. 2F illustrates a top view of the kid plate 200, FIG. 2G illustrates a front bottom left isometric view of the kid plate 200, FIG. 2H illustrates an alternative front bottom left isometric view of the kid plate 200, FIG. 2I illustrates a rear top right isometric view of the kid plate 200, and FIG. 2J illustrates an alternative rear top right isometric view of the kid plate 200. The kid plate 200 is used for sports conditioning in athletes. In particular, the kid plate 200 allows an athlete to perform an exercise, such as a bench press, in a way that better builds muscle in a way that directly correlates to better performance in sports. The kid plate 200 is similar to the sports specific and injury preventing exercise device but designed to be used by younger users, such as teens. In particular, the kid plate 200 is designed to allow a spotter to assist a younger user and to handle smaller amounts of weight. I.e., younger users should limit how much weight they are using and should use spotters more often than advanced users. Therefore, the kid plate 200 is different than the sports specific and injury preventing exercise device 100 to accommodate these differences.

For example, the kid plate 200 can include a frame 104 which is smaller than the sports specific and injury preventing exercise device 100 of FIG. 1. In addition, the spacing between handles 106 can be smaller to account for the smaller trunk size of younger users Moreover, because the frame of the kid plate 200 is smaller than the sports specific and injury preventing exercise device 100 of FIG. 1, the assist handles 112 can be nearer to one another and are parallel to one another (as opposed to perpendicular to one another as in the sports specific and injury preventing exercise device 100 of FIG. 1).

FIG. 2 further shows that the kid plate 200 can lack supports. The lack of supports means that the weight cannot be racked in the same manner as the sports specific and injury preventing exercise device 100 of FIG. 1. This discourages users form placing too much weight on the kid plate 200. In particular, since a spotter will be required to help place the kid plate 200, significant amounts of weight will not be placed on the kid plate 200 and a spotter will always be present.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sports specific and injury preventing exercise device for exercising a user, the sports specific and injury preventing exercise device comprising:
- a frame;
- a pair of handles on the frame, wherein the pair of handles are:
  - parallel to one another;
  - do not share an axis;
  - configured to be parallel to a trunk of the user;
  - offset relative to the frame; and
  - on opposite sides of the frame;
- a flat support area in a middle of the frame, wherein the flat support area is configured to support one or more weight plates;
- a sleeve attached to the flat support area, wherein the sleeve is:
  - configured to extend away from the chest of the user when the user is holding a first handle in the pair of handles in his/her right hand and a second handle in the pair of handles in his/her left hand;
  - perpendicular to each of the pair of handles;
  - perpendicular to the flat support area; and
  - located at a center point of the frame;
- one or more assist handles, wherein the assist handles:
  - are configured to allow a spotter to support a weight of the frame; and
  - each perpendicular to the sleeve; and
- a pair of supports, wherein:
  - each of the pair of supports and each of the assist handles are separated from one another and share an axis; and
  - the pair of supports are attached to the frame.

2. The sports specific and injury preventing exercise device of claim 1, wherein the one or more assist handles includes a pair of assist handles.

3. The sports specific and injury preventing exercise device of claim 2, wherein the pair of assist handles are parallel to one another.

4. The sports specific and injury preventing exercise device of claim 2, wherein each of the pair of assist handles are perpendicular to the pair of handles.

5. The sports specific and injury preventing exercise device of claim 1 further comprising a pair of inner assist handles, wherein the pair of inner assist handles are attached to the frame.

6. The sports specific and injury preventing exercise device of claim 5, wherein the pair of inner assist handles are on opposite sides of the frame relative to one another.

7. The sports specific and injury preventing exercise device of claim 1, wherein the frame is approximately rectangular.

8. The sports specific and injury preventing exercise device of claim 1, wherein the pair of supports are interior to the one or more assist handles.

9. The sports specific and injury preventing exercise device of claim 1, wherein the pair of supports are on opposite sides of the frame relative to one another.

10. A sports specific and injury preventing exercise device for exercising a user, the sports specific and injury preventing exercise device comprising:
- a frame, wherein the frame is approximately rectangular;
- a pair of handles on the frame, wherein the pair of handles are:
  - parallel to one another;
  - do not share an axis;
  - configured to be parallel to a trunk of the user;
  - offset relative to the frame; and
  - on opposite sides of the frame;

a flat support area in a middle of the frame, wherein the flat support area is configured to:
support one or more weight plates; and
form a plane which is parallel to a chest of the user when the user is holding the pair of handles;
a sleeve attached to the flat support area, wherein the sleeve is:
configured to extend away from the chest of the user when the user is holding the pair of handles;
configured to be on the midline of the chest of the user when the user is holding the pair of handles;
perpendicular to each of the pair of handles;
perpendicular to the flat support area; and
located at a center point of the frame;
a pair of assist handles, wherein the pair of assist handles:
are configured to allow a spotter to support a weight of the frame;
each perpendicular to the pair of handles; and
each include a major axis, wherein the major axis is perpendicular to the sleeve; and
a pair of supports, wherein:
each of the pair of supports and each of the assist handles are separated from one another and share an axis; and
the pair of supports are attached to the frame.

11. The sports specific and injury preventing exercise device of claim 10, wherein the pair of supports are each:
interior to the pair of assist handles;
parallel to the pair of assist handles;
perpendicular to the pair of handles; and
perpendicular to the sleeve.

12. The sports specific and injury preventing exercise device of claim 11, wherein the pair of supports are on opposite sides of the frame relative to one another.

13. The sports specific and injury preventing exercise device of claim 12 further comprising a pair of inner assist handles, wherein the pair of inner assist handles are attached to the frame.

14. The sports specific and injury preventing exercise device of claim 13, wherein:
each of the pair of inner assist handles and each of the pair of supports and each of the pair of assist handles share a single axis; and
the pair of inner assist handles are interior to the pair of supports.

15. The sports specific and injury preventing exercise device of claim 13, further comprising one or more stops between each inner assist handle and a corresponding nearest support of the pair of supports.

16. The sports specific and injury preventing exercise device of claim 13, further comprising one or more stops between each support and a corresponding nearest assist handle of the pair of assist handles.

17. The sports specific and injury preventing exercise device of claim 10, wherein the pair of handles are offset between 0.25 and 0.75 inches.

18. The sports specific and injury preventing exercise device of claim 10, wherein the pair of handles are offset 0.5 inches.

* * * * *